US007589267B1

(12) United States Patent
Sims

(10) Patent No.: US 7,589,267 B1
(45) Date of Patent: Sep. 15, 2009

(54) PICK ASSEMBLY FOR PLAYING A STRINGED MUSICAL INSTRUMENT

(76) Inventor: Arthur Sims, 1410 17th St., SW., Naples, FL (US) 34117

( * ) Notice: Subject to any disclaimer, the term of this patent is extended or adjusted under 35 U.S.C. 154(b) by 0 days.

(21) Appl. No.: 12/271,976

(22) Filed: Nov. 17, 2008

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS

| | | | |
|---|---|---|---|
| 557,293 | A | 3/1896 | Wahl |
| 3,648,558 | A | 3/1972 | Chenette |
| 3,735,663 | A | 5/1973 | Cowell, Sr. |
| D291,809 | S | 9/1987 | Jasper |
| 5,973,243 | A | 10/1999 | Christenson |
| 6,054,643 | A | 4/2000 | Chance et al. |
| 6,242,677 | B1 | 6/2001 | Sander |
| 6,797,871 | B2 | 9/2004 | Atkin |
| 6,903,256 | B2 | 6/2005 | Pittman et al. |
| 6,949,700 | B1 | 9/2005 | Kelly |
| 2004/0159207 | A1 | 8/2004 | Glyde |
| 2006/0086231 | A1 | 4/2006 | Sielaff |
| 2006/0156895 | A1 * | 7/2006 | Judd et al. ..... 84/320 |

* cited by examiner

*Primary Examiner*—Kimberly R Lockett
(74) *Attorney, Agent, or Firm*—Mattingly & Malur, P.C.

(57) ABSTRACT

A pick assembly for use in playing a stringed musical instrument includes a pick holder having an elongated body adapted to fit on an underside of a thumb of a user and a pick hingedly attached to the pick holder adjacent one end of the body. A band is provided at an intermediate portion of the body which engages the thumb of the user and the pick includes a slot for receiving a tab at one end of the body to form a hinge connection with the tab which permits up and down movement of the pick with respect to the tab.

15 Claims, 5 Drawing Sheets

PICK ASSEMBLY FOR PLAYING A STRINGED MUSICAL INSTRUMENT

BACKGROUND OF THE INVENTION

1. Field of the Invention

The present invention relates to a pick assembly for use in playing a stringed musical instrument and, more particularly, to such an assembly having a pick holder with a pick hingedly attached thereto.

2. Description of the Related Art

A pick has long been used to play stringed instruments. The pick is also known as a plectrum and is a small flat tool used to pluck or strum a stringed instrument. The pick is typically a narrow, isosceles triangle with rounded corners and the most acute angle of the pick is the one which constitutes the pick tip used to pluck the string of the musical instrument. The size, shape and width of a pick may vary considerably. Generally a pick is adapted to be held on the thumb or between the finger and thumb of a user.

A guitar is commonly played with the pick held between the thumb and first finger of a hand and the tightness with which the pick is held determines how much movement of the pick occurs when striking the strings. This refers not to hand movement but to movement of the pick itself beneath the thumb. This movement of the pick produces differences in the angle at which the pick strikes the strings and provides for a feel that is useful to guitarists in producing variations of tone and loudness in the sound of the instruments.

Picks worn on the thumb are generally referred to as thumbpicks. Thumbpicks are important because they free the fingers to operate independently from the thumb. Thumbpicks, however, sacrifice movement of the pick beneath the thumb. This occurs because in order to keep a thumbpick in place, a band around the thumb is needed and must be made of a material which will tightly hold the pick to the thumb when playing. This often results in undesirably thick material having to be used, an uncomfortable fit, and most significantly, the desired up and down movement of the pick beneath the thumb is sacrificed.

Past efforts and endeavors by inventors to overcome the above-noted thumbpick difficulties haven't fully resolved the difficulties. For example, the tip of a thumbpick can be made more thin then it's band, allowing flexibility in the material at the tip. This, however, doesn't produce the feel or tone that a pick held loosely under the thumb can produce. Other efforts have involved changes in the length and shape of the pick without addressing the desirability of up and down movement under the thumb. Efforts that have addressed this desired up and down movement haven't enabled the thumb alone to vary and control how much of this movement occurs. Neither have such efforts kept the flesh of the thumb, next to the strings, entirely free and clear.

SUMMARY OF THE INVENTION

It is an object of the present invention to provide a pick assembly having a pick mounted at the end of a holder by a hinge connection which allows the pick to freely move up and down.

Another object of the present invention is to provide a pick assembly which enables the thumb, by itself, to grip the pick and thereby maintain control of how much movement of the pick occurs when plucking or striking the strings of a musical instrument.

A further object of the invention is to provide a pick assembly which keeps the flesh of the thumb free and clear along the outside of the thumb next to the strings so as to not interfere with the flesh of the thumb stopping the sound of the string.

Still another object of the present invention is to provide a thumbpick which does not fit too tightly on the thumb.

A still further object of the invention is to provide a pick assembly which keeps the pick properly positioned under the thumb at all times and keeps it properly aimed at the strings when playing a string instrument.

Another object of the present invention is to provide a pick assembly which allows for any standard flatpick to be slotted for use with a pick holder and make the flatpick function as a thumbpick.

A further object of the present invention is to provide a pick assembly which provides comfort for the hand of a player.

The present invention achieves the above and other objects by providing a pick assembly for use in playing a stringed musical instrument wherein the pick assembly is comprised of a pick holder having an elongated body adapted to fit on an underside of a thumb of user and a pick hingedly attached to the pick holder adjacent one end of the body. The pick holder further includes a tab at the one end of the body which is provided with a groove on each side at an inner end thereof so that the grooves engage a slot of the pick whereby the pick is removably snap fitted onto the tab. A band is provided at an intermediate portion of the body which engages the thumb of the user behind the outer joint thereof but which extends only partially around the thumb whereby an outside edge of the thumb is left uncovered by the band and may contact the strings of the musical instrument.

The slot in the pick forms a hinged connection with the tab which permits up and down movement of the pick with respect to the tab. The tab is integrally connected to one end of the body by a wall portion extending generally perpendicular to the one end of the body and the tab. The wall portion preferably extends at an angle of about 60-65 degrees to the longitudinal axis of body when measured in a horizontal plane. The body further is provided with a downwardly extending curved extension at an opposite end of the body so that when the assembly is mounted to a thumb, the curved extension is positioned where the thumb meets the palm of the hand and assists in keeping the holder comfortable.

The hinged area provided by the tab fitting through the slot of the pick is advantageous in that it permits the tab to provide a small platform for the pick to be pressed against by the thumb and therefore allows the thumb alone to control the up and down movement of the pick. Moreover, the slot connection also provides resistance for the thumb to press the pick against by virtue of the contact which is made by the top of the back edge of the pick against an underside of the body of the holder.

These, together with other objects and advantages, which will be subsequently apparent, reside in the details of construction and operation as more fully described and claimed hereafter, reference being made to the accompanying drawings forming a part hereof, wherein like numerals refer to the like parts throughout.

DETAILED DESCRIPTION OF THE PREFERRED EMBODIMENTS

Figure 1:
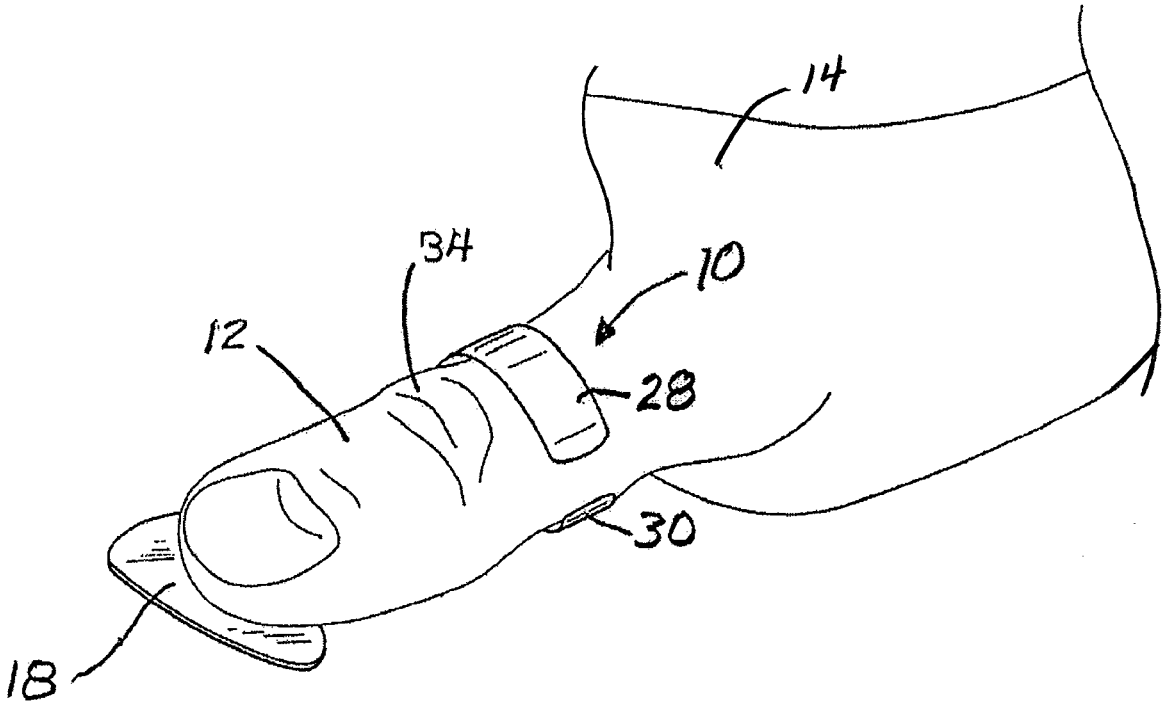
FIG. 1 is a perspective view of a pick assembly according to the present invention mounted on a thumb of a user.
Figure 6:
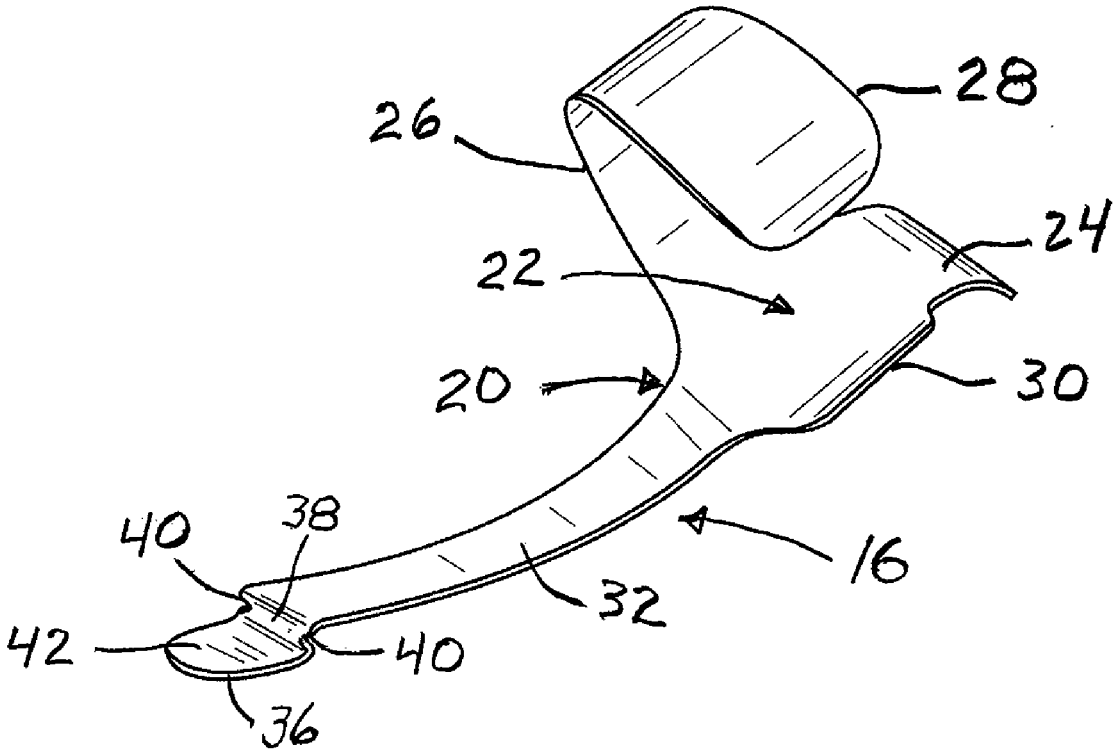
FIG. 6 is a perspective view of the pick holder of the pick assembly.
Figure 7:
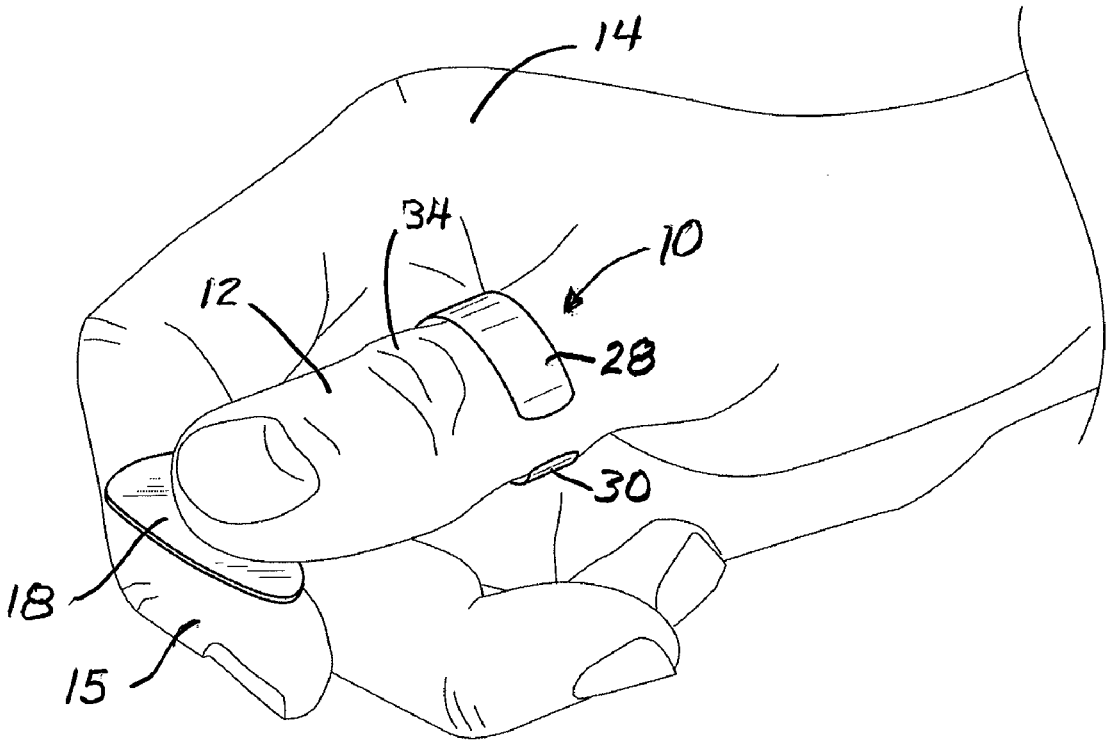
FIG. 7 is a perspective view of the pick assembly mounted on the thumb of the user and illustrating the pick being further supported by an index finger of a hand.

Referring to the drawings, the pick assembly, generally referred to by the numeral 10, is shown mounted on a thumb 12 of a hand 14 of a user. The pick assembly is intended for use by a musician for playing a stringed musical instrument such as a guitar. As shown in FIG. 1, the pick assembly is mounted on the thumb in such a manner that the thumb, by itself, is able to grip the pick and maintain control of the movement of the pick when plucking or striking the strings of a musical instrument such as a guitar. Gripping the pick by an additional finger, such as an index finger, is not necessary. As shown in FIG. 6, however, another finger such as an index finger 15, also may be used to grip the pick.

Figure 4:
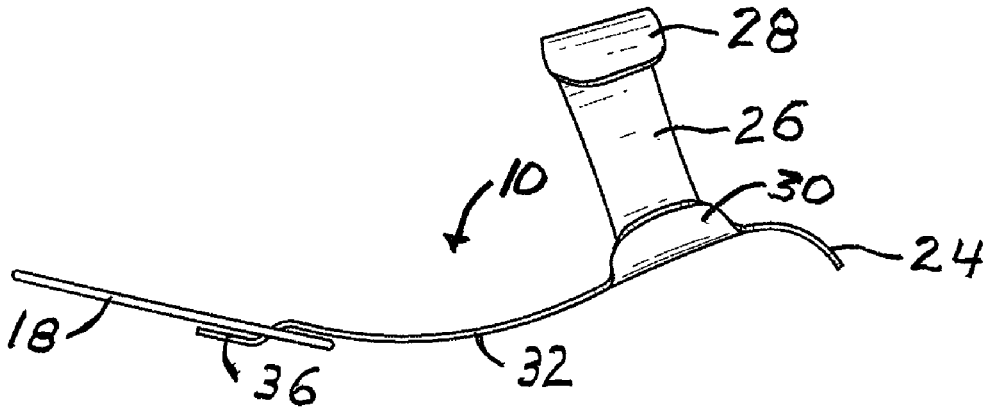
FIG. 4 is a side elevational view of the pick assembly.
Figure 5:
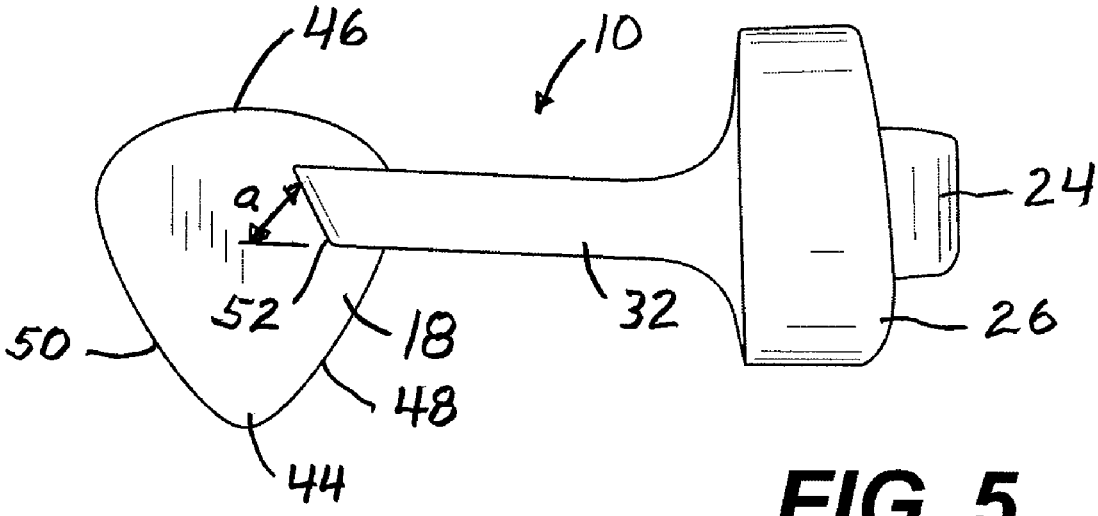
FIG. 5 is a top view of the pick assembly.

The pick assembly 10, as shown in FIGS. 4 and 5, is comprised of a pick holder, generally indicated by the numeral 16, having a pick 18 hingedly attached thereto. The pick holder and thumb work like a pair of pliers to hold the pick.

The pick is preferably made of a plastic material and the holder is made of a thin metal material which can be shaped into a desired configuration. A suitable holder may be made from a thin piece of stainless steel. The holder, however, also could be made of plastic and molded into the desired shape.

Figure 2:
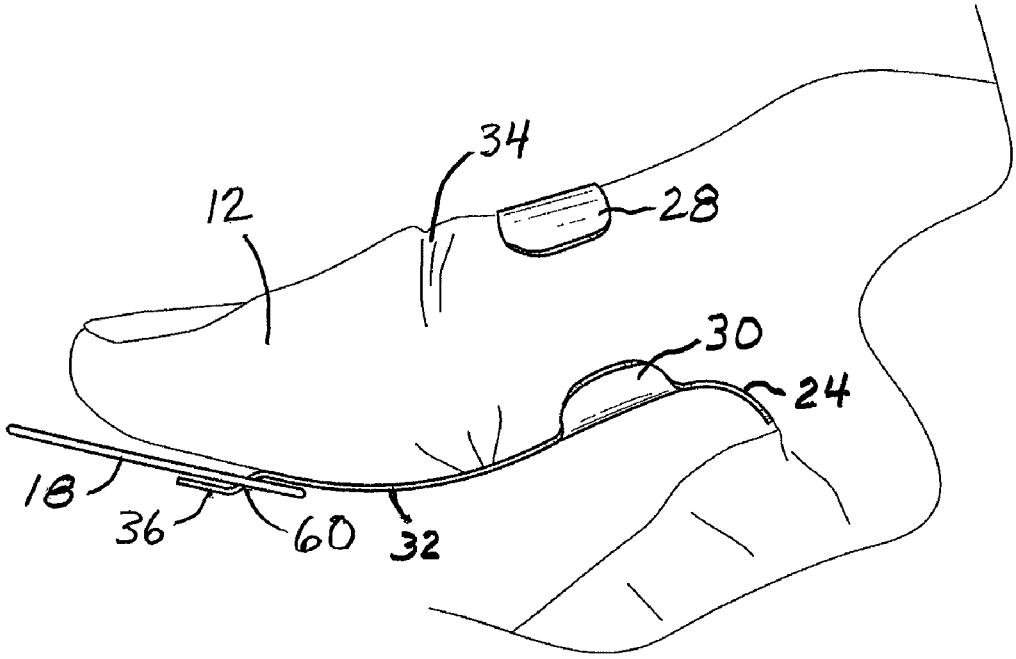
FIG. 2 is a side elevational view of the pick assembly mounted on the thumb of the user illustrating the end of the thumb spaced from the pick mounted on the pick holder.
Figure 3:
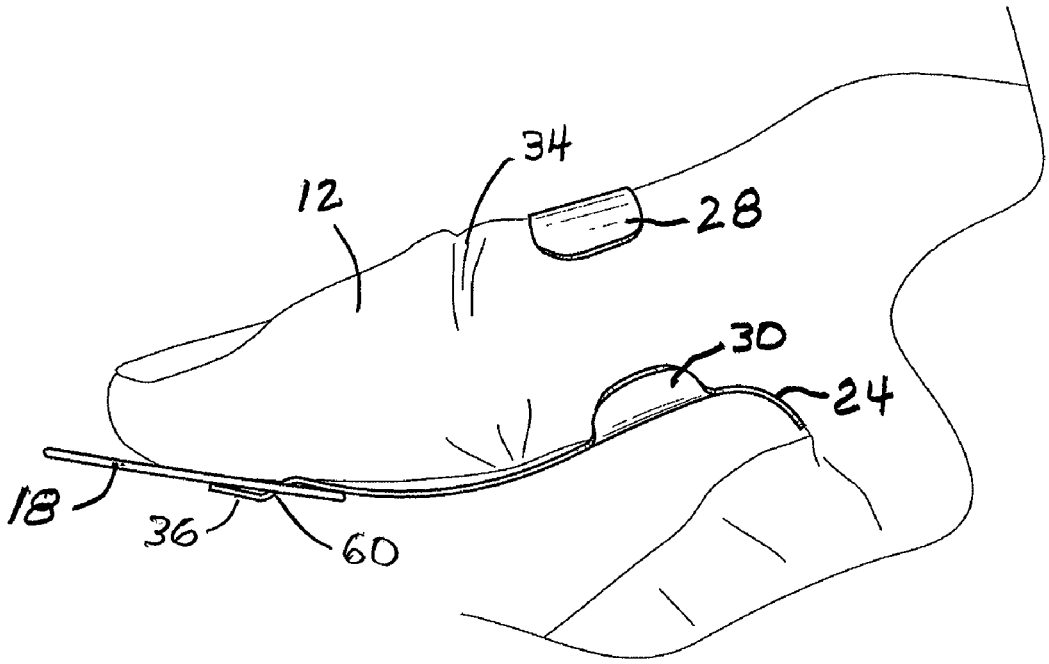
FIG. 3 is a side elevational view of the pick assembly showing the thumb of the user pressed against the pick.

As shown in FIG. 6, the pick holder 16 includes a body 20 having an enlarged base portion 22 intermediate the ends thereof and, more particularly, adjacent an inner end thereof. The inner end of the body 20 has a downwardly curved extension or tab 24 at the inner end which, as shown in FIGS. 2 and 3, nests under the thumb at the portion where the thumb meets the palm of the hand. This downwardly curved extension permits the holder to remain comfortably attached to the thumb during use by a user.

The pick holder 16 is provided with a band 26 which encircles part but not all of the thumb at a position inwardly of an outer joint or knuckle 34 of the thumb as shown in FIGS. 1-3. The band 26 includes a first segment 28 which extends outwardly from the inner side of the base portion 22 and wraps around the top of the thumb but does not extend over the outside edge of the thumb. The band further includes a second band segment 30 which extends from the outside edge of the base portion 22 and is curved around the outside of the bottom portion of the thumb but does not extend over the outside edge of the thumb. This construction of the partial band permits the outside edge of the thumb to be free and clear on the side where the strings of the instrument are located so as to avoid interfering with the flesh of the thumb from stopping the sound of a string when this is desired.

The body 20 of the holder further includes a stem 32 which extends outwardly from the center of the base portion and has a curved concave shape which conforms to and fits the underside of the thumb when the thumb is extended straight outwardly as shown in FIG. 2.

A tab 36 is attached at the outer end of the stem 32 of the body 20 of the pick holder by a wall portion 38 which extends downwardly from the end of the stem portion and which is generally perpendicular to the end of the stem 32 and the inner end of the tab 36. A groove 40 is formed on each side of the inner end of the tab 36 at the point where the tab is connected to the bottom of the wall portion 38 as shown in FIG. 6. The tab 36 has a flat top portion which forms a platform 42 for engagement with the bottom surface of pick 18 as shown in FIG. 3.

As shown in FIG. 5, the outer end of stem 32 is at an angle a with respect to the longitudinal axis of the stem when measured in a horizontal plane of the stem. The angle a is preferably between 60 and 65 degrees with an angle of 63 degrees being preferred. The wall 38 connecting the end of the stem 32 to the inner end of the tab 36 is also at the same angle as it extends downwardly from the end of the stem to the inner end of the tab 36.

The pick 18 preferably is made of a plastic material and is in the general shape of an isosceles triangle with the tip 44 of the pick being at the sharpest angle. The tip 44 is the portion of the pick used for plucking or strumming the stringed instrument.

As shown in FIG. 5, the pick 18 has a back edge 46, a first side edge 48 and a second side edge 50. The pick is provided with an angled slot 52 adjacent a corner formed by the back edge 46 and the first side edge 48. The slot 52 is at the same angle as the outer end of the stem 32 so that when the tab 36 is inserted through the slot, the pick is positioned generally perpendicular to the longitudinal axis of the stem whereby the pick tip 44 extends outwardly from the thumb towards the strings of an instrument. The width of the tab at the grooved end is slightly larger then the width of the slot so that when the tab is inserted through the slot the material of the pick gives slightly so that the tab snaps into place in the groves and the pick is securely held in place at the end of the pick holder.

The slot 52 in the pick, the wall portion 38 and the tab 36 with the grooves 40 combine to form a hinge 60 whereby the pick 18 may be pivoted up and down by pressure from the end of the thumb. Thus, as shown in FIG. 2, when the end of the thumb is not pressed down on the top of the pick 18, the pick 18 does not engage the top of the tab 36 or the bottom of the end of the stem 32. As shown in FIG. 3, however, when the end of the thumb is pressed downwardly on top of the pick 18, the bottom of the pick engages the platform 42 on the top of the tab 36 and the top of the back portion of the pick 18 engages the bottom of the end of the stem 32. Thus, the pressure of the thumb keeps the pick in a secure position when the thumb presses down on the pick.

The pick assembly of the present invention affords many advantages. The pick is hinged on the holder in such a manner as to provide a desired amount of up and down movement. The holder is also designed to work with the outer joint of the thumb so that together, the thumb and pick holder are similar to a pair of pliers applying the desired amount of pressure upon the pick and thereby controlling how much movement of the pick occurs. This is made possible by the band of the pick holder being placed behind the outer joint of the thumb so that the thumb joint functions like a lever against the holder. The stem extending from the band of the holder conforms and follows the underside of the thumb to place the pick at it's proper location and to keep it properly positioned. The pick holder makes it possible to take a flat pick and make it into a thumbpick.

The pick is slotted to fit on the end of the holder so that the pick doesn't slip from side to side but remains aimed at the strings.

The band of the holder does not wrap entirely around the thumb but keeps the flesh of the thumb next to the strings, free and clear so as to avoid interfering with the flesh of the thumb stopping the sound of the string when this is desired.

The pick is prevented from coming loose from the holder by the holder receiving the pick in the two small grooves which the pick snaps into. Moreover, the band of the holder does not have to fit as tightly around the thumb as a regular thumbpick because the band is placed behind the outer joint of the thumb rather then near the tip of the thumb where it could easily slip off and because even the slightest touch of the thumb near the pick assists in keeping the pick and its holder in place. The extension at the base end of the holder where the thumb meets the palm of the hand is curved downwardly to assist in keeping the holder comfortable to the hand. The platform on the top of the tab in the hinge area permits the pick to be pressed against the platform by the thumb, thus allowing the thumb to accurately control how much up and down movement of the pick occurs. There is also a resistance for the thumb to press the pick against when contact is made at the back edge of the pick against the underside of the stem.

The hinge area is angled so as to aim the pick at the strings and to provide the best up and down movement of the pick while not extending the tip of the holder so far as to interfere with striking the strings.

Numerous other modifications and adaptations of the present invention will be apparent to those skilled in the art and thus, it is intended by the following claims to cover all such modifications and adaptations which fall within the true spirit and scope of the invention.

What is claimed:

1. A pick assembly for use in playing a stringed musical instrument, comprising:

a pick holder having an elongated body adapted to fit on an underside of a thumb of a user; and a pick hingedly attached to said pick holder adjacent one end of said body;

said pick holder further comprising:

a tab at one end of said body;

a band at an intermediate portion of said body which engages the thumb of the user; and wherein said pick includes a slot therein for receiving said tab to form a hinged connection with said tab which permits up and down movement of said pick with respect to said tab.

2. The pick assembly according to claim 1 wherein said band extends only partially around the thumb whereby an outside edge of the thumb is left uncovered by the band.

3. The pick assembly according to claim 1 wherein said tab is provided with a groove on each side at an inner end thereof so that the slot of said pick engages said grooves whereby said pick is removably snap fitted onto said tab.

4. The pick assembly according to claim 3 wherein said tab is integrally connected to said one end of said body by a wall portion extending generally perpendicular to said one end of said body and said tab.

5. The pick assembly according to claim 4 wherein said pick includes a pick tip, a back edge, a first side edge and a second side edge, and said slot is positioned adjacent a corner formed by said back edge and said first side edge whereby a bottom surface of said pick engages a top surface of said tab and a top surface of said pick engages a bottom surface of said body when the tab is inserted through the slot and the pick assembly is engaged with the thumb and the thumb exerts pressure on the top surface of the pick.

6. The pick assembly according to claim 4 wherein said wall portion extends at an angle to a longitudinal axis of said body and said tab when measured in a horizontal plane.

7. The pick assembly according to claim 6 wherein said angle is between 60-65 degrees.

8. The pick assembly accordingly to claim 1 wherein said body is provided with a downwardly curved extension at an opposite end of said one end.

9. The pick assembly according to claim 1 wherein said body is provided with an enlarged base portion adjacent an opposite end of said one end.

10. The pick assembly according to claim 9 wherein said band is connected to a side edge of said base portion and engages the thumb at a position inwardly from an outer joint of the thumb.

11. The pick assembly according to claim 1 wherein said pick is hingedly attached to said body of said pick holder at a generally perpendicular angle thereto whereby a pick tip for plucking the strings of the musical instrument faces the musical instrument.

12. A pick assembly for use in playing a stringed musical instrument, comprising:

a pick holder having an elongated body adapted to fit on an underside of a thumb of a user; and a pick hingedly attached to said pick holder adjacent one end of said body, said pick having a slot therein;

said pick holder further comprising:

a tab at one end of said body, said tab having a groove on each side at an inner end thereof so that the slot of said pick engages said grooves to form a hinged connection therewith and said pick is removably snap fitted onto said tab;

a band at an intermediate portion of said body which engages the thumb of the user at a position inwardly from an outer joint of the thumb; and a downwardly curved extension at an opposite end of said body.

13. The pick assembly according to claim 12 wherein said band extends only partially around the thumb whereby an outside edge of the thumb is left uncovered by the band.

14. The pick assembly according to claim 12 wherein said tab is integrally connected to said one end of said body by a wall portion extending generally perpendicular to said one end of said body and said tab.

15. The pick assembly according to claim 12 wherein said pick includes a pick tip, a back edge, a first side edge and a second side edge and said slot is positioned adjacent a corner formed by said back edge and said first side edge whereby a bottom surface of said pick engages a top surface of said tab and a top surface of said pick engages a bottom surface of said body when the tab is inserted through the slot and the pick assembly is engaged with the thumb and the thumb exerts pressure on the top surface of the pick.

* * * * *